United States Patent [19]

Thornton

[11] 4,056,031

[45] Nov. 1, 1977

[54] TRUSS WEB CUTTER

[76] Inventor: Jack L. Thornton, P.O. Box 213, Pacific Grove, Calif. 93950

[21] Appl. No.: 731,602

[22] Filed: Oct. 12, 1976

[51] Int. Cl.[2] ..... B27B 13/00; B27M 3/04

[52] U.S. Cl. ..... 83/794; 83/807; 83/809; 144/30; 83/581

[58] Field of Search ..... 83/581, 794, 83/795, 796, 797, 798, 799, 800, 801, 807, 808, 809; 144/30

[56] References Cited

U.S. PATENT DOCUMENTS

| | | | |
|---|---|---|---|
| 469,177 | 2/1892 | Sperry | 83/796 |
| 1,211,974 | 1/1917 | Smart | 144/30 |
| 2,556,670 | 6/1951 | Ashworth | 83/798 |
| 3,073,361 | 1/1963 | Pavelka | 144/30 |

*Primary Examiner*—Donald R. Schran
*Attorney, Agent, or Firm*—Robert K. Rhea

[57] ABSTRACT

An upright stand horizontally supports an elongated workpiece from which truss webs are to be cut. The stand includes a vertical column supporting a motor driven head driving an endless band saw blade substantially describing a figure eight. The crossed portions of the band saw blade form angular surfaces on the respective ends of a web cut from the workpiece by downward movement of the head.

7 Claims, 11 Drawing Figures

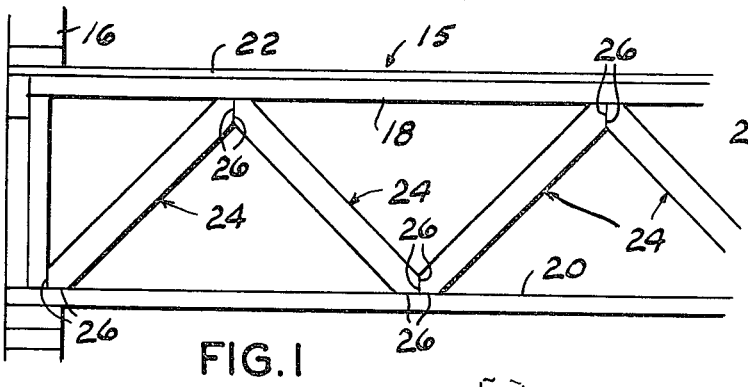
FIG. 1
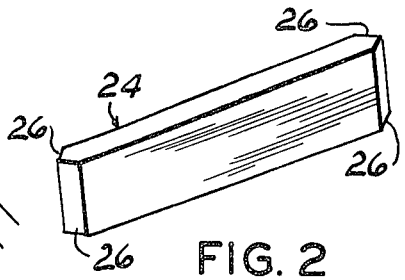
FIG. 2
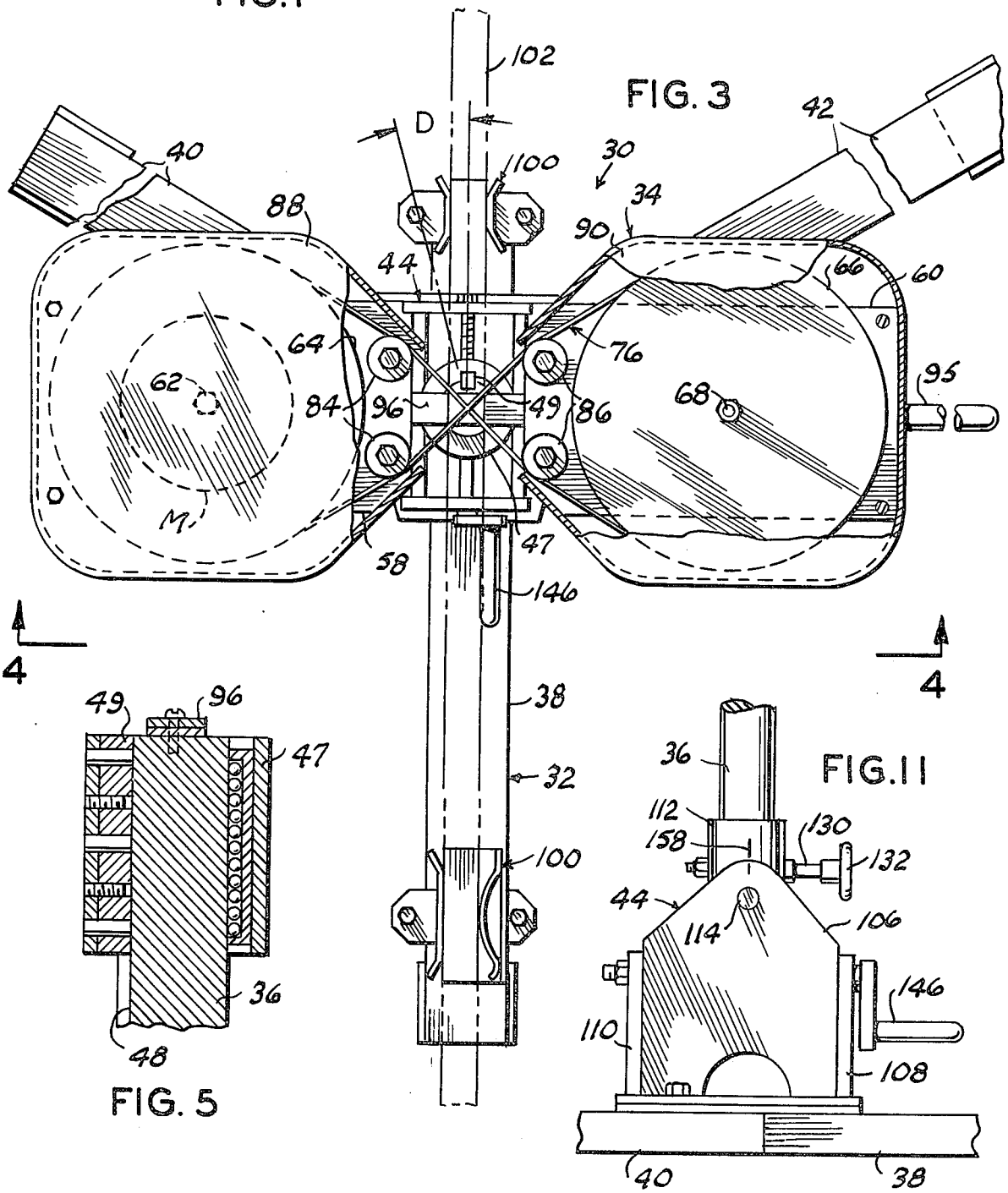
FIG. 3
FIG. 5
FIG. 11

TRUSS WEB CUTTER

BACKGROUND OF THE INVENTION

1. Field of the Invention.

The present invention relates to miter saws and more particularly to a band saw type device for simultaneously cutting angularly disposed end surfaces on the ends of truss webs or braces.

Floor braces or webs for forming a floor truss, or the like, in building construction are usually disposed in angular relation between the components forming the upper and lower limits of a truss. The webs are each provided with angular end surfaces for respectively engaging confronting surfaces of the generally horizontal upper and lower limits of the truss being formed and simultaneously engaging an end surface of the adjacent truss web to increase rigidity. Forming truss webs usually requires two cuts be made on the respective ends of each web.

This invention reduces the web cutting time by simultaneously forming desired angular end surfaces on the web by one pass of a saw.

2. Description of the Prior Art.

Truss web end surfaces have usually been formed on the respective ends of each web section by a radial saw or by miter guides including a portable electric hand saw, such as disclosed by U.S. Pat. Nos. 2,630,146; 2,941,554 and 3,130,578. However, as mentioned hereinabove, such saw equipment also requires that two angular cuts be made on each end of each truss web.

This invention provides a crossed band saw blade type cutter which simultaneously cuts one end surface of a pair of truss webs in desired end surface angular relation by one pass of the saw blade.

SUMMARY OF THE INVENTION

An upright stand horizontally supports a workpiece for forming truss web sections. The standing includes a vertical column slidably supporting a motor driven head for vertical movement. The head includes a pair of pulleys around which an endless band saw blade is entrained in crossed substantially figure eight position so that the 90° crossed position of the band saw blade is vertically movable downwardly normal to the axis of the truss web forming workpiece. The cutting head is rotatable in one direction about the vertical axis of its supporting column to alter the crossed position of the band saw blade with respect to longitudinal axis of the workpiece and form desired angular end surfaces on truss webs. The cutting head and its supporting column may also be tilted toward one end of the truss web forming workpiece and with respect to the normally vertical axis of the column to form angular transverse end surfaces on truss webs in angular relation with respect to the transverse axis of the respective web.

The principal object of this invention is to provide a truss web cutter for simultaneously cutting cooperating angular end surfaces on one end of two truss web sections of minimizing the time usually required for forming four angularly disposed truss web end surfaces.

BRIEF DESCRIPTION OF THE DRAWINGS

FIG. 1 is a fragmentary diagram of a floor truss;

FIG. 2 is a perspective view of a truss web;

FIG. 3 is a top view of the truss web cutter;

FIG. 5 is a fragmentary vertical cross section, to a larger scale, taken substantially along the line 5—5 of FIG. 4;

DESCRIPTION OF THE PREFERRED EMBODIMENTS

Figure 4:
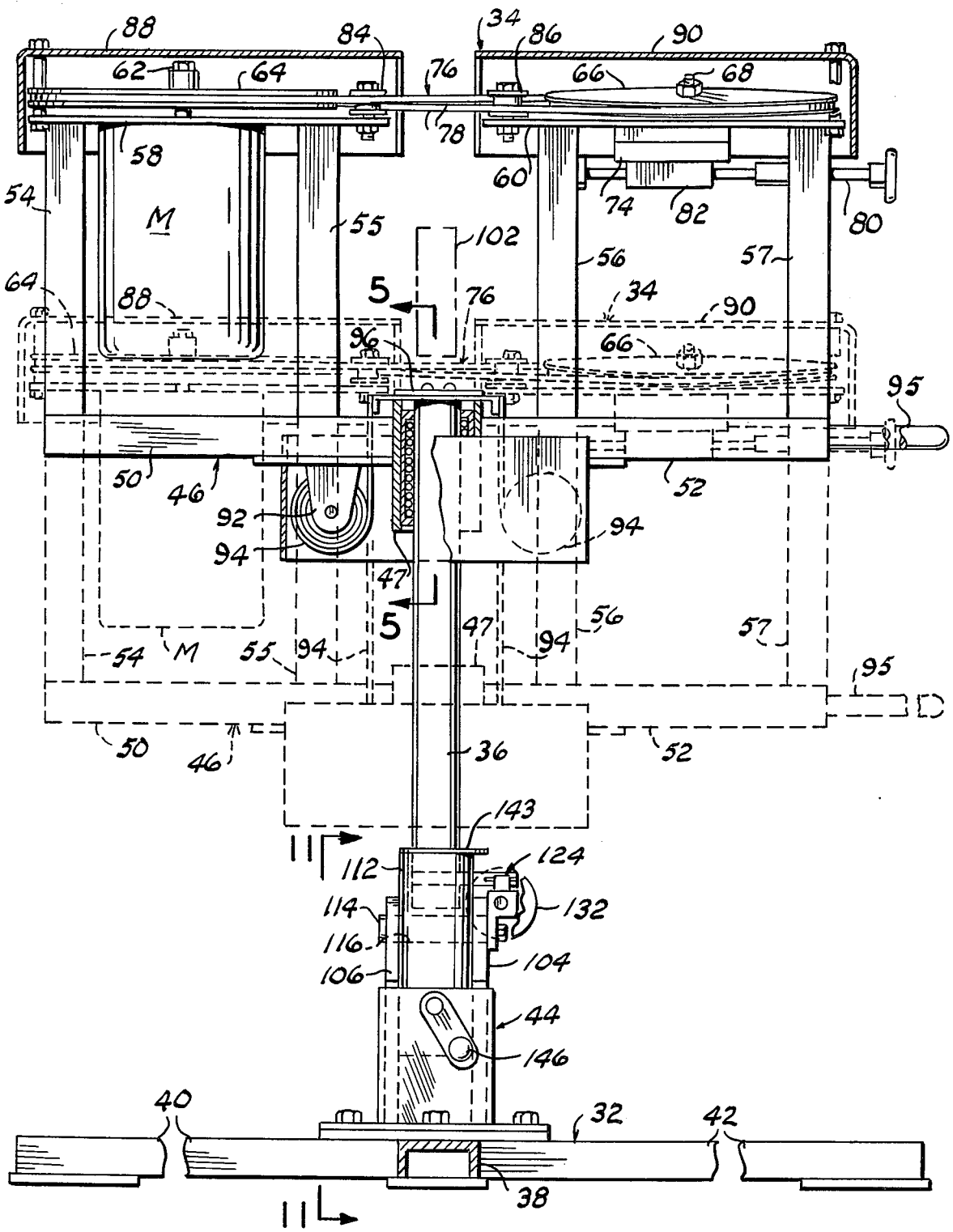
FIG. 4 is a fragmentary front elevational view, looking in the direction of the arrows 4—4 of FIG. 3, with portions broken away and sectioned, for clarity and illustrating, by dotted lines, the vertical movement of the cutter head assembly relative to a workpiece shown in phantom lines.

Like characters of reference designate like parts in those figures of the drawings in which they occur.

In the drawings:

Referring to FIGS. 1 and 2, the reference numeral 15 indicates a floor truss projecting laterally of a wall 16. The truss 15 comprises spaced upper and lower members 18 and 20 underlying a floor 22 to be supported and includes a plurality of diagonally disposed braces or webs 24 extending between the upper and lower members 18 and 20 and having angular end surfaces cooperatively engaging each other and the respective upper and lower members 18 and 20. Each truss brace or web 24 is formed from a length of material, for example wood, of rectangular cross section with the respective end of the web having cooperating angular surfaces 26, totalling 90°, coextensive with the transverse width of the respective web. These web end surfaces 26 are formed on desired angles, according to the panel length of the truss, for cooperative engagement with each other and the respective member being maintained in spaced-apart relation, as illustrated in FIG. 1. The above description is conventional with floor trusses, or the like, and is set forth to illustrate the type of web truss members to be formed from a workpiece by the present invention.

Referring now to FIGS. 3 through 6, the reference numeral 30 indicates the truss web cutter, as a whole, comprising a horizontal platform 32 supporting a cutter head assembly 34 by a normally vertical column 36. The platform or base 32 is substantially Y-shaped, in top view, comprising a central arm 38 and angularly disposed arms 40 and 42. A pivot housing 44, mounted on the base at the juncture of its arms supports the depending end portion of the cutter head support column 36 for rotative and tilting action of the column and cutter head, as presently explained.

The cutter head assembly 34 comprises a frame 46 overlying the upper end of the column 36 transversely of the longitudinal axis of the base arm 38. The frame 46 includes a bearing equipped sleeve 47 surrounding and vertically slidably secured to the upper end portion of the column 36 (FIG. 5). The upper end portion of the column 36 is provided with a vertical keyslot 48 slidably receiving a key 49 secured within the sleeve 47. A pair of frame base members 50 and 52 are respectively secured, as by welding, at one end portion to the sleeve 47 in longitudinal aligned relation transversely of the base arm 38. Two pairs of frame uprights 54–55 and 56–57 are respectively secured in parallel spaced upstanding relation to the respective end portions of the frame base members 50 and 52. A pair of pulley support plates 58 and 60 horizontally overlie the respective frame uprights 54–55 and 56–57 and are secured thereto.

An electric motor M is mounted in depending relation from the pulley support plate 58 between the frame uprights 54–55 with the motor drive shaft 62 projecting vertically upward through the pulley support plate. A drive pulley 64 is coaxially connected to and driven by the motor drive shaft 62.

Figure 6:
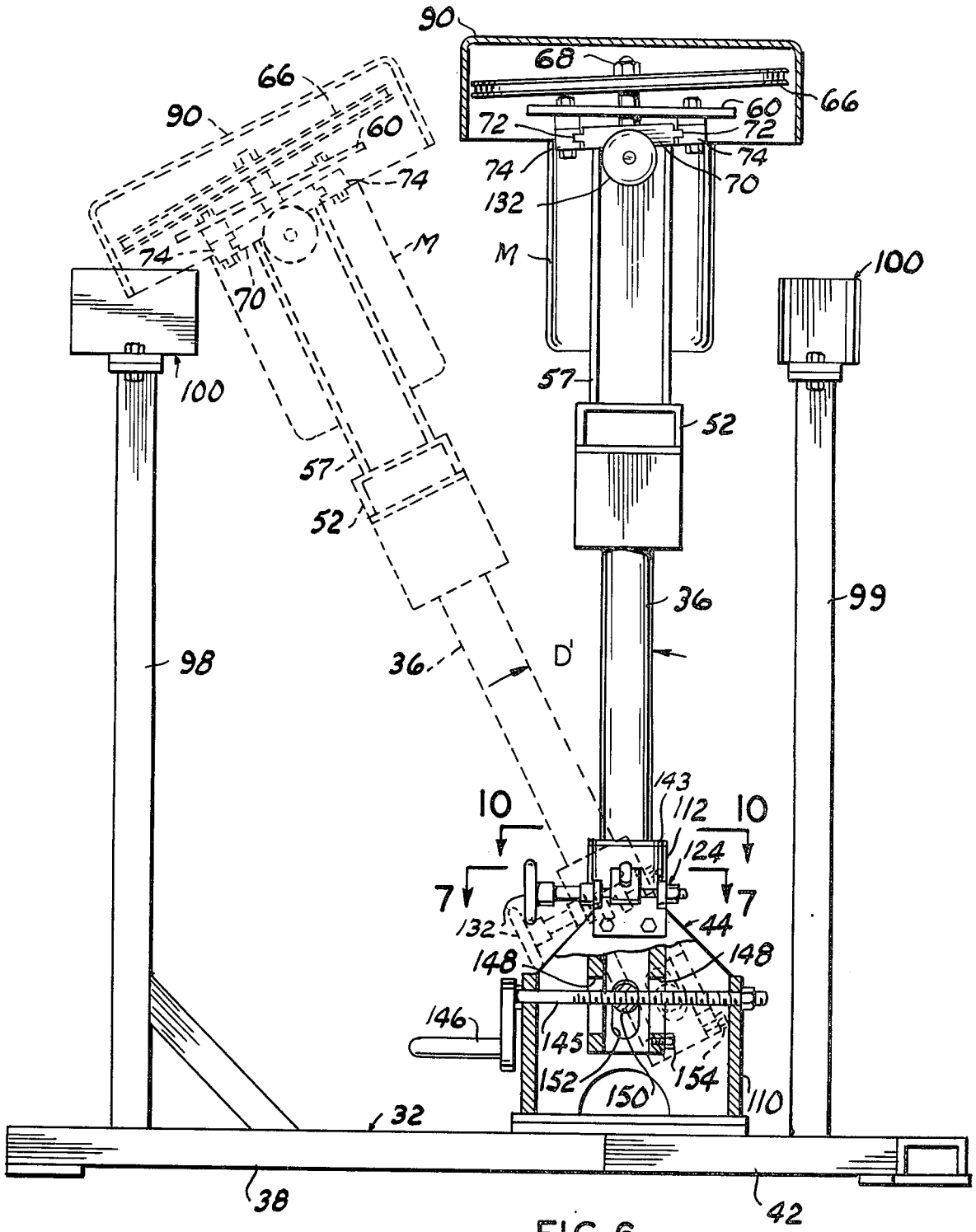
FIG. 6 is a right side elevational view of FIG. 4 with portions broken away and sectioned for clarity and illustrating, by dotted lines, a tilted position of the cutter head and support column.

As best shown by FIG. 6, a driven pulley 66 is coaxially mounted on a shaft 68 projecting through a suitable opening formed in the pulley support plate 60 and secured at its depending end to a slide 70 disposed between the frame uprights 56–57 and having a tongue 72 on opposing marginal side edges slidable in tongue grooves formed in a pair of parallel guides 74 secured in depending relation to the pulley support plate 60. The plane of the slide 70 is tilted downwardly at a selected angle toward the support base 32 to similarly tilt the central axis of the pulley 66 for the reasons presently explained. Each of the pulleys 64 and 66 are provided with a flat bottom groove for cooperative reception of an endless band saw type blade 76 disposed in a crossed substantially figure eight position so that the toothed edge 78 of the band saw remains disposed downwardly. The tilted position of the driven pulley 66, with respect to the vertical, permits the band saw to pass without contact between its upper and lower run at the crossed position of the blade which is aligned with the vertical axis of the column 36. Tension on the saw blade 76 is adjusted by a hand screw 80 supported by the frame uprights 56–57 and having its threaded shaft threadedly engaging a depending lug 82 formed on the slide 70.

As best shown by FIG. 3, the crossed intermediate portions of the band saw blade 76 are maintained in 90° angular relation by two pairs of rollers 84 and 86 respectively secured to the upper surface of the pulley support plates 58 and 60 so that respective intermediate portions of the blade contact alternate rollers. A pair of pulley and plate shields 88 and 90, inverted cup-shaped in general configuration overlie the respective pulley, support plate and rollers as by a safety feature.

A pair of spring tension reels 92 are mounted in depending relation on the lower surface of the respective frame base 50 and 52 adjacent the sleeve 47. Each of the reels are provided with an elongated flexible band 94 wound thereon with one end of each band 94 extending through a suitable vertical slot formed in the respective frame base 50 and 52 and secured to the respective ends of a spring retainer 96 transversely overlying and secured to the upper limit of the column 36. The spring tension of the reels 92 is such that they maintain the head 34 normally disposed in the solid line position of FIG. 4, but permit the head to be manually moved downwardly to its dotted line position by a handle 95 secured to the frame head 46, as presently explained.

The support base 32 further includes a pair of workpiece supporting posts 98 and 99 connected at their depending ends to the respective end portions of the frame center arm 38. Each of the posts 98 and 99 are provided at their upper end portion with upstanding workpiece guide holders 100 forming a horizontal workpiece path between the frame uprights 55 and 56 for receiving an elongated plant-like workpiece 102 from which the truss webs 24 are to be cut when the workpiece is disposed vertically edgewise. The height of the workpiece supporting posts is such that the crossed position of the saw blade 76 is disposed in spaced relation above the upper limit of the workpiece 102 (FIG. 3) and similarly the depending limit of the workpiece, when supported by the posts, is disposed in spaced relation with respect to the upper limit of the column 36, for the reasons readily apparent.

Referring also to FIGS. 7 through 11, the pivot housing 44 is upwardly open box-like in general configuration comprising a pair of side panels 104 and 106 joined in parallel spaced relation by end panels 108 and 110. A centrally bored pivot fitting 112 is pivotally connected between the side panels 104 and 106 by a pivot pin 114 extending horizontally through the upper end portions of the side panels and a transverse bore 116 (FIG. 4) formed through the fitting 112 intermediate its ends for vertical tilting movement of the fitting about the horizontal axis of the pin 114, for the reasons presently explained.

The upper end portion of the fitting 112 is counterbored or receiving the depending end portion of the column 36. A horizontal slot 118 is formed in the wall of the fitting 112 adjacent the side panel 104 in cooperative alignment with a transverse bore 120 formed through the depending end portion of the column 36 for receiving one end portion of a lockpin 122 and horizontally rotating the column 36 and saw head 34 about a vertical axis by movement of the lockpin 122, as presently explained. The outwardly projecting end portion of the lockpin is provided wth parallel vertical flat surfaces.

Figure 7:
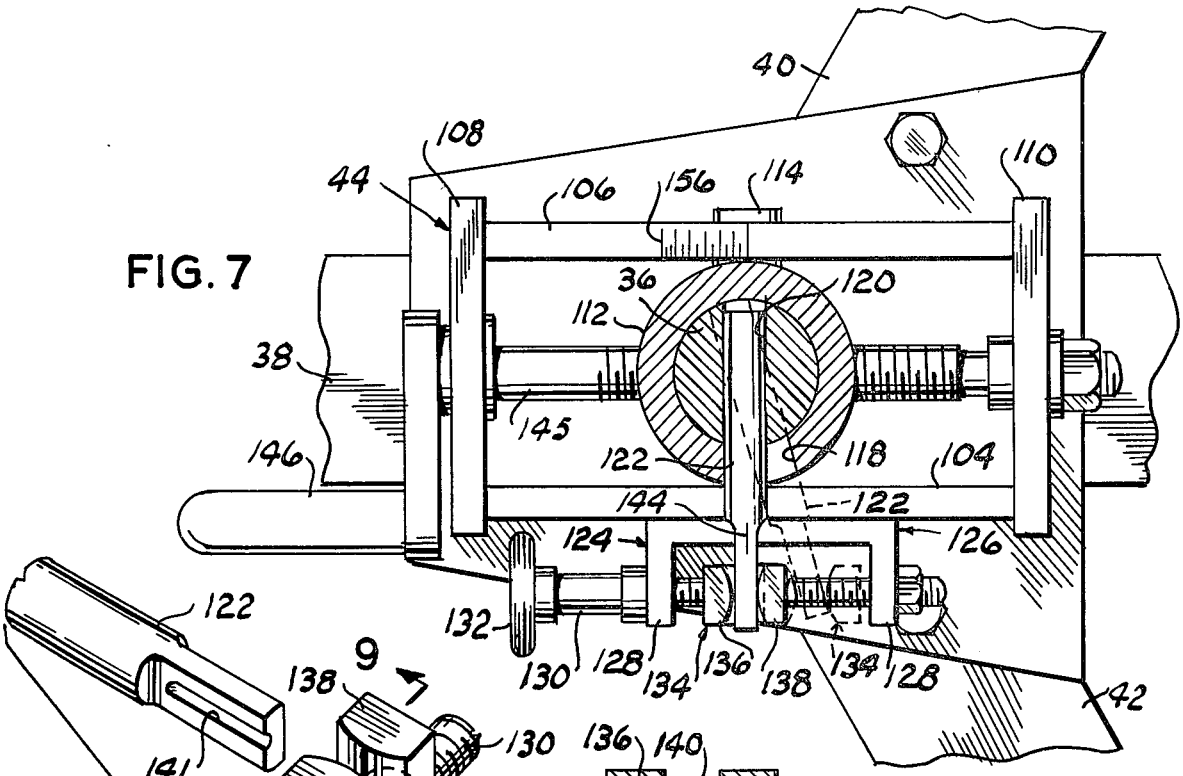
FIG. 7 is a horizontal sectional view, to a larger scale, taken substantially along the line 7—7 of FIG. 6 and illustrating, by dotted lines, rotatable movement of the cutter head and supporting column.

The horizontal length of the slot 118 is such that the column 36 and saw head 34 may be rotated in a counterclockwise direction, as viewed in FIGS. 3 and 7, through a distance of not more than 15°, as indicated by the dimension D in FIG. 3 and the solid and dotted line positions of the lockpin of FIG. 7, for the purposes presently explained.

This horizontal rotating movement of the lockpin is achieved by an adjustment screw means 124 comprising a substantially U-shaped bracket 126 secured to the pivot housing panel 104 below the lateral projecting end portion of the lockpin 122. The bracket 126 includes a pair of horizontal legs 128 which are line drilled on a horizontal axis for journalling an adjustment screw 130 rotated by a hand wheel 132.

A clevis 134 is threadedly engaged with the adjustment screw 130 between the bracket legs 128. The clevis arms 136 and 138 are normally disposed upwardly on opposing sides of the flat surfaces of the laterally projecting end portion of the lockpin so that rotation of the adjustment screw, in one direction, horizontally moves the lockpin 122 toward its dotted line position (FIG. 7) thus rotating the column 36 and saw head 34. The clevis arm 136 is provided with a spring urged ball 140 normally engaging a horizontal groove 141 formed in the adjacent flat surface of the lockpin thus permitting the clevis 134 to be manually pivoted downwardly to its dotted line position, best shown by FIG. 8, for the purposes presently explained. The desired degree of horizontal rotative movement of the column 36 and head assembly 34 is observed by scored lines 142, indicating degrees, formed on a plate 143 overlying the upper end of the pivot fitting 112, (FIGS. 4, 6 and 10), and registerable with a scored line 144 (FIG. 10) formed on the lockpin 122.

Figure 8:
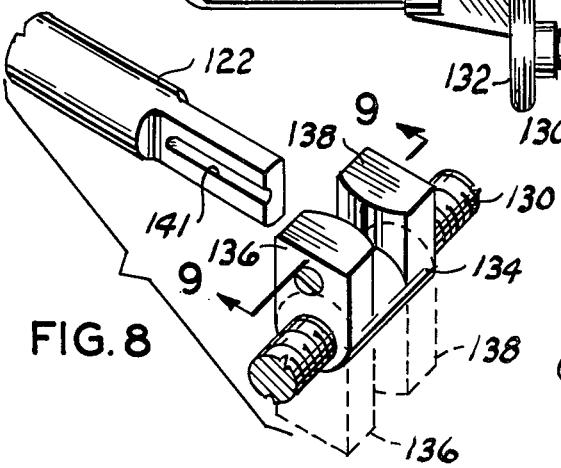
FIG. 8 is a fragmentary exploded perspective view illustrating the components for horizontally rotating the cutter head supporting column about its vertical axis.
Figure 9:
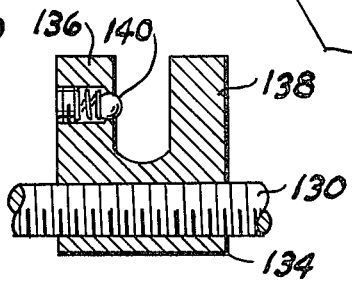
FIG. 9 is a vertical cross sectional view taken substantially along the line 9—9 of FIG. 8.
Figure 10:
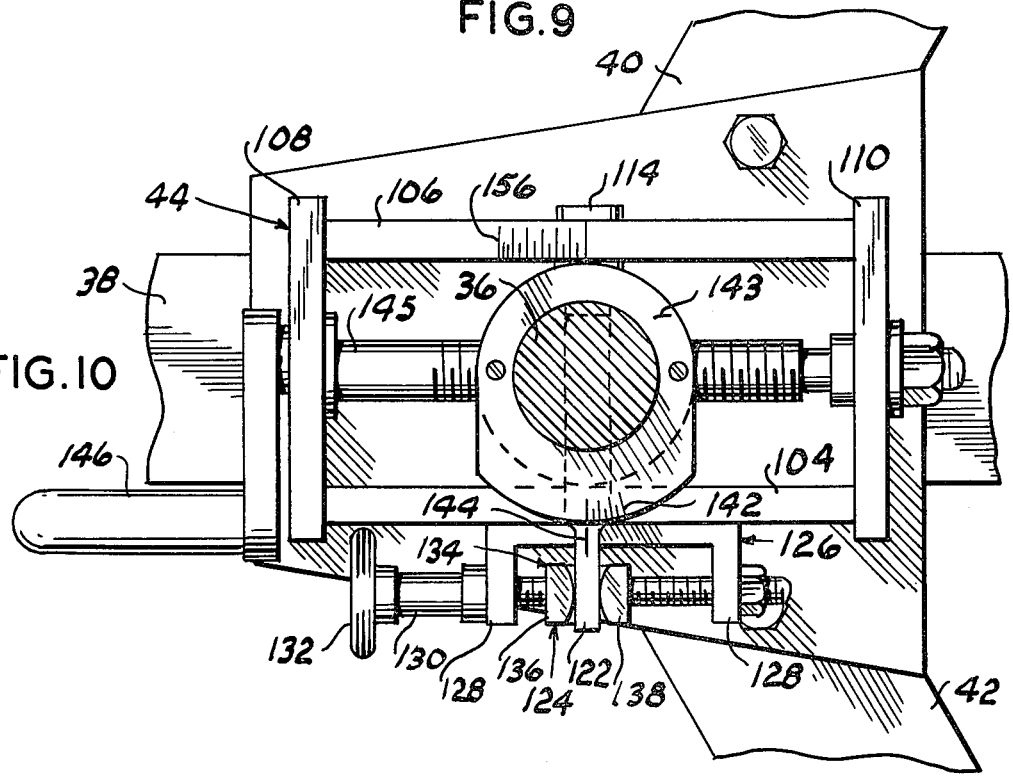
FIG. 10 is a view similar to FIG. 7 taken substantially along the line 10—10 of FIG. 6; and, FIG. 11 is a fragmentary elevational view looking in the direction of the arrows 11—11 of FIG. 4.

The pivot housing end panels 108 and 110 are horizontally line drilled for receiving a threaded tilt screw 145 provided with a crank handle 146 at one end. The tilt screw 145 projects through vertically aligned slots 148 (FIG. 6) formed in the depending end of the pivot fitting 112. A stub pin 150 is provided with a medial transverse bore threadedly engaging the tilt screw 145. The length of the stub pin 150 is substantially equal to the outside diameter of the pivot fitting 112. The respective end portions of the stub pin are disposed within cooperating diametrically opposite vertical slots 152 formed in the wall of the pivot fitting spaced 90° with respect to the above mentioned slots 148. Rotation of the tilt screw 145, in one direction, permits vertical tilting movement of the column 36 and saw head 34 about the horizontal axis of the pivot pin 114 toward the post 98 when the clevis 134 has been manually pivoted downwardly to its dotted line position (FIGS. 6 and 8). The vertical tilting movement of the column and saw head thus described is preferably through an angle not greater than 27°, as indicated by the distance D' (FIG. 6). The predetermined degree of this tilting movement may be controlled by a stop screw 154 adjustably engaged threadedly with the wall of the depending end portion of the fitting 112 so that when the screw 154 contacts the pivot housing end panel 110 it forms a stop limiting the tilting movement, as illustrated by dotted lines (FIG. 6). The degree of angular tilting movement is best observed by scale indicia 156, indicating degrees (FIG. 10), scored on the upper end portion of the pivot housing side panel 106 for registration with a scored line 158 (FIG. 11) vertically formed on the adjacent surface of the upper end portion of the pivot fitting 112.

OPERATION

In operation, the workpiece 102 is manually disposed on the support clips 100. With the motor M driving the saw blade 76, the saw head 34 is manually moved downwardly against the spring tension of the reels 92, as by using the handle 95, wherein the crossed position of the saw blade forms 45° miter cuts transversely of the workpiece with the saw head positioned as shown by FIG. 3. After making one such cut, which simultaneously forms miter cuts on one end of two truss webs 24, the workpiece is then moved a desired distance and when supported by the clips 100 the saw head 34 is again moved vertically downwardly to form a similar transverse cut through the workpiece completing one truss web 24 and forming miter cuts on one end of the next succeeding workpiece to be similarly cut. When the desired angle of the miter cuts, to be formed on the ends of the workpiece, is other than 45° angle cuts, the column 36 and saw head 34 are horizontally rotated a desired number of degrees in a counterclockwise direction by rotating the adjustment screw 122 as described hereinabove. Similarly, if the mitered cuts are to be formed transversely of the workpiece, other than on a plane normal to the longitudinal axis of the web, the column 36 and saw head 34 may be tilted toward the support post 98 by rotating the tilting screw 145 as previously described.

Obviously the invention is susceptible to changes or alterations without defeating its practicability. Therefore, I do not wish to be confined to the preferred embodiment shown in the drawings and described herein.

I claim:

1. An apparatus for forming miter cuts on the ends of truss webs, comprising:

support base means for supporting an elongated plank-like workpiece in a horizontal path;

column means including a column normally supported vertically by said support base means, the upper end of said column terminating below the horizontal workpiece path; and, cutter head means slidably supported by said column for acting on a workpiece when said cutter head means is moved vertically across the workpiece path, said cutter head means including, a frame including a pair of horizontal frame base members, sleeve means including a sleeve interposed between and connected with said frame base members and surrounding the upper end portion of said column, a spring retainer overlying and secured to the upper end of said column, spring reel means including an elongated spring band secured to said frame base members adjacent said column, said spring reel means including an elongated band having one end secured to said spring retainer for normally maintaining the upper end of said sleeve adjacent said spring retainer, said base frame members having frame uprights mounted thereon and terminating at their upper ends in a horizontal plane spaced above the workpiece path, a pair of pulleys journalled by said frame uprights in a generaly horizontal plane, an endless band saw blade substantially describing a figure eight and entrained around said pulleys with the point of intersection of the crossed portions of the blade coaxially aligned with the vertical axis of said column, and, a motor drivably connected with one said pulley.

2. The apparatus according to claim 1 in which the plane of one said pulley is tilted in a direction parallel with the workpiece path for disposing the crossed portions of said saw blade in vertical spaced relation.

3. The apparatus according to claim 2 in which said cutter head means further includes:

two pairs of rollers mounted on said frame means between said pulleys and on respective opposing sides of the workpiece path for maintaining intermediate portions of said saw blade adjacent its crossed position in selected angular relation.

4. The apparatus according to claim 3 in which said support base means includes:

at least one support base member;

a pair of upstanding posts mounted on said support base member and disposed in spaced relation longitudinally of the workpiece path; and, a workpiece holder secured to the upper end of each said post.

5. The apparatus according to claim 4 and further including:

pivot housing means interposed between said support base member and said column for horizontal rotation of said column about its vertical axis and vertical pivoting movement of said column about a horizontal axis in a direction parallel with the workpiece path.

6. The apparatus according to claim 5 in which said pivot housing means includes:

a pair of upstanding spaced-apart parallel side panels;

a generally cylindrical pivot fitting disposed vertically between said side panels, said fitting having a bore in its upper end portion nesting the depending end portion of said column and having a horizontal slot formed in its wall forming the bore;

a lockpin slidably received horizontally intermediate its ends by the horizontal slot and projecting at one end portion into the depending end portion of said column, the other end portion of said lockpin projecting beyond the vertical plane of one said side panel;

a clevis bracket secured to said one side panel below the horizontal axis of said lockpin;

a rotatable adjusting screw horizontally journalled by said clevis bracket; and, a clevis having arms disposed on opposing sides of said lockpin and being threadedly engaged with said adjusting screw.

7. The apparatus according to claim 5 in which said pivot housing means includes:

a pair of upstanding side panels;

pair of end panel joining said side panels in parallel spaced-apart relation;

a generally cylindrical pivot fitting disposed vertically between said side panels, said fitting having a bore in its upper end portion nesting the depending end portion of said column;

a pivot pin extending transversely through said side panels and said fitting, said fitting having a first vertical slot in its depending end portion parallel with said side panels and having a second vertical slot transversely intersecting the first slot;

a rotatable tilting screw extending horizontally through the first slot and journalled by said end panels; and, a stub pin threadedly engaged medially its ends with said tilting screw and disposed within the second slot of said fitting.

* * * * *